United States Patent [19]

Yoshida

[11] 4,314,470

[45] Feb. 9, 1982

[54] ROLLER DIE WIRE DRAWING DEVICE HAVING A PLURALITY OF ROLLER DIE UNITS

[76] Inventor: Keiichiro Yoshida, No. 641, Mobara, Mobara City, Chiba Prefecture, 297, Japan

[21] Appl. No.: 87,303

[22] Filed: Oct. 22, 1979

[30] Foreign Application Priority Data

Mar. 15, 1979 [JP] Japan ..... 54-30198

[51] Int. Cl.[3] ..... B21B 31/00

[52] U.S. Cl. ..... 72/234

[58] Field of Search ..... 72/224, 234, 235

[56] References Cited

U.S. PATENT DOCUMENTS

| | | | |
|---|---|---|---|
| 201,002 | 3/1878 | Gilbert | 72/235 |
| 808,356 | 12/1905 | Foster | 72/235 |
| 3,380,278 | 4/1968 | Dilling | 72/224 |
| 3,677,056 | 7/1972 | Propezzi | 72/234 |
| 3,733,874 | 5/1973 | Spiecker | 72/235 |
| 4,198,841 | 4/1980 | Vydrin et al. | 72/224 |

FOREIGN PATENT DOCUMENTS

| | | | |
|---|---|---|---|
| 931540 | 7/1963 | United Kingdom | 72/235 |

*Primary Examiner*—Milton S. Mehr

*Attorney, Agent, or Firm*—Wenderoth, Lind & Ponack

[57] ABSTRACT

The invention is related to a wire drawing device having a plurality of roller die units. Each unit contains two opposing grooved rollers which are respectively mounted in bearing frames which are connected to one another in an opposing fashion by threaded shanks. The shanks are rotatable and function to regulate the distance between the rollers. Each unit is housed in a square frame. The square frames are structured and dimensioned such that they can be serially aligned whereby the radial planes of each adjacent set of grooved rollers are perpendicular to one another thus allowing the distance between adjacent rollers to be less than the diameter of the rollers.

10 Claims, 8 Drawing Figures

ROLLER DIE WIRE DRAWING DEVICE HAVING A PLURALITY OF ROLLER DIE UNITS

BACKGROUND OF THE INVENTION

1. Field of the Invention

This invention is related to a roller die wire drawing device wherein a plurality of die units are serially aligned. Specifically, each roller die unit comprises two opposing rollers, and the rollers have grooves therein. Each grooved roller of each unit is assembled in a bearing frame. The bearing frames are oppositely positioned in a housing frame, and the housing frames including the roller die units are serially aligned such that the rollers of each unit are adjacent one another.

2. Description of the Prior Art

The known roller die systems for a wire drawing process have hitherto been structured such that many units of grooved rollers were serially arranged in a framework, and the bearings of each of the grooved rollers were adjustably positioned so that the wire drawing process could be performed.

In these systems, it is inevitable that the framework has to be large so as to resist the strong forces associated with the wire drawing process. Thus, the framework is remarkably large as compared to the other elements of the wire drawing device. Generally the wire to be drawn through the grooved rollers has a tendency to twist, and since the wire drawing process is performed sequentially whereby the wire serially passes through several roller dies, these known roller die systems have the inherent characteristic of the aforementioned drawn wire twisting phenomenon. And furthermore, as the distance between any two adjacent rollers increases, the amount of twisting of the drawn wire increases. This is one reason why the distance between the adjacent rollers must be as small as possible. However, heretofore it was considered to be very difficult to minimize the distance between any two adjacent rollers such that that distance could be smaller than the diameter of the grooved rollers.

BRIEF SUMMARY OF THE INVENTION

An object of the present invention is to provide a roller die device comprising a plurality of roller die units which can be serially positioned and aligned so as to avoid the above-mentioned disadvantage inherent in the conventional wire drawing system. Another object of the present invention is have a roller die device which is relatively small and simple in construction. Therefore, in order to attain these and other objectives, the roller die device of the present invention comprises a plurality of roller die units serially positioned and aligned such that wire can be drawn therethrough. Each roller die unit has two opposing grooved rollers respectively rotatably assembled in a pair of bearing frames which are in turn oppositely positioned in a housing frame. The housing frames are serially aligned and are detachably connected so that the radial planes of the grooved rollers in any two adjacent housing frames are perpendicular to each other, and the distance between any two adjacent grooved rollers is smaller than the diameter of the grooved rollers of the roller die units. Further, the roller die units are fastened together by a plurality of common assembly shafts.

BRIEF DESCRIPTION OF THE DRAWING

The objectives and advantages of the present invention will be more fully explained by the following description of a preferred embodiment together with the accompanying drawings in which.

DETAILED DESCRIPTION OF THE PREFERRED EMBODIMENT

Figure 5:
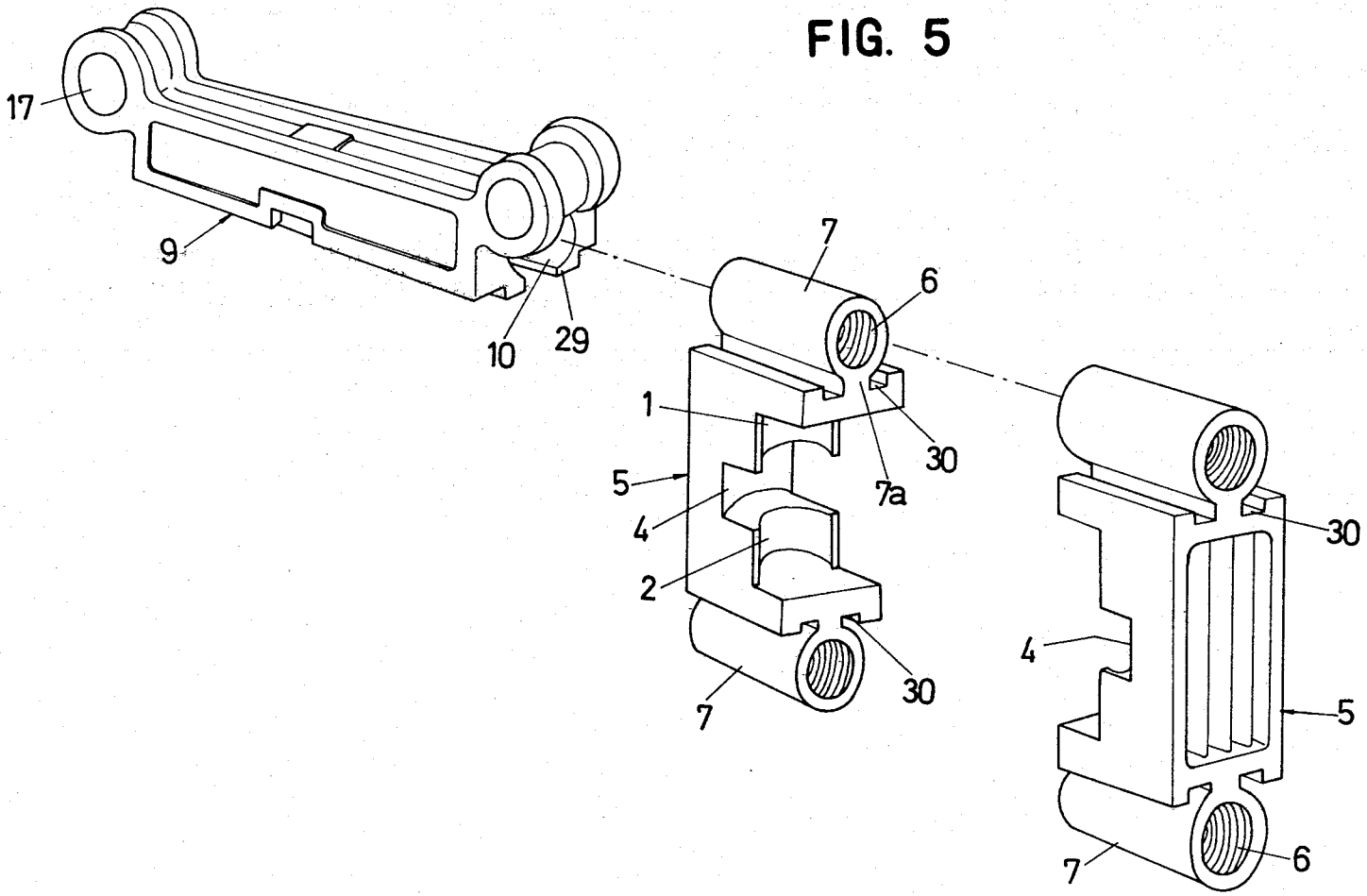
FIG. 5 is a perspective view indicating the shapes of and relationships between the housing and bearing frames of the wire drawing device of the present invention.

Referring to FIG. 5, a bearing frame 5 has semicircular bearing spaces 1, 2 respectively at its upper and lower inside portions, a cavity space 4 for installing a grooved roller 3 therein, and cylindrical bosses 7 each respectively connected to the frame 5 by a connecting stem *7a* situated on each outer wall of the upper and lower sides, and wherein each boss 7 has a threaded hole 6 therethrough and the outer periphery is dimensioned so as to slide inside a housing frame 9. Each of the semicircular bearing spaces 1,2 has a plurality of needle roller bearings 8 which surround the shaft of each of the grooved rollers 3.

Both sides of the connecting stems *7a* have two grooves 30, which dovetail with projections 29, of housing frames 9. The cylindrical bosses 7 and grooves 30, are positioned symmetrically at the upper and lower sides of bearing frame 5, so that each frame 5 is of a standard size and configuration.

Figure 3:
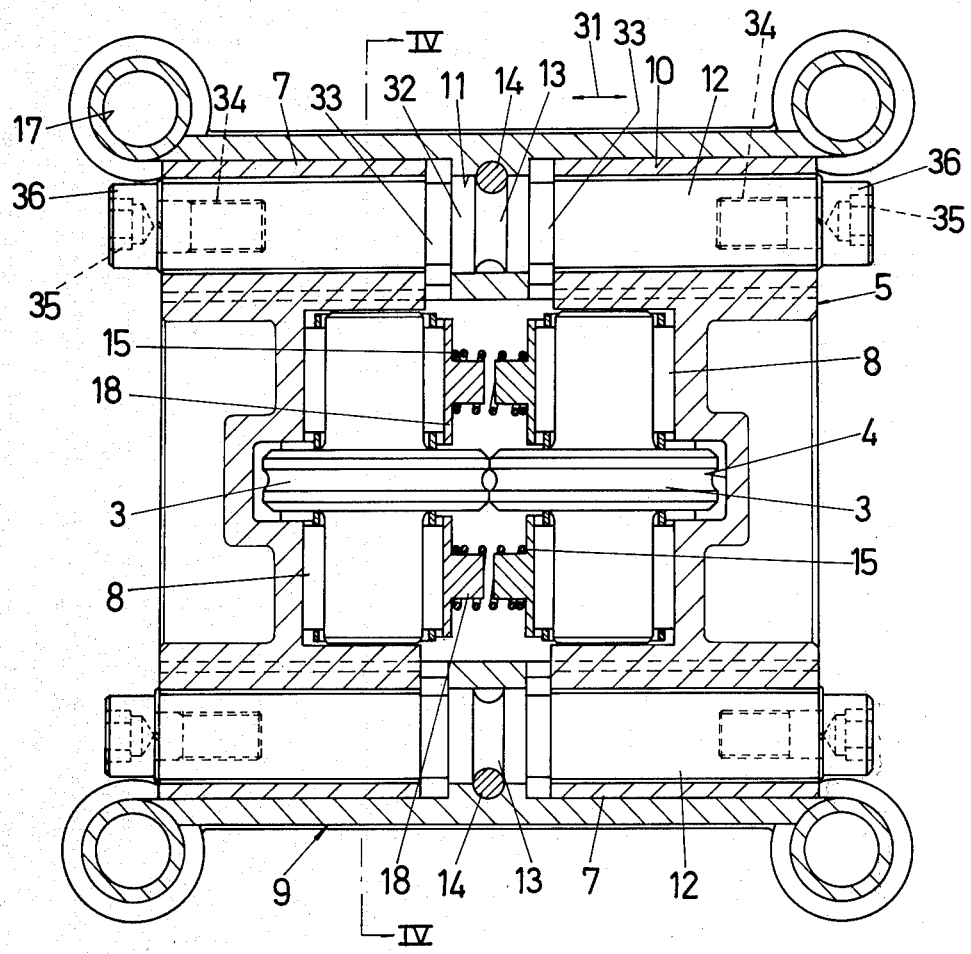
FIG. 3 is a partial sectional front view taken along the line III—III of FIG. 2 showing the assembly of the grooved rollers and an adjusting mechanism within a bearing frame of a roller die unit of the wire drawing device according to the present invention.

Two bearing frames 5 have grooved rollers 3 positioned therebetween and are respectively attached by a dovetail connection to a pair of housing frames 9. Each housing frame 9 has a slender long rectangular body and has an elongated groove 10 which extends along its total length along a side (FIG. 5) for accommodating the cylindrical bosses 7 of the bearing frames 5, and the center of the elongated groove 10 is provided with an annular shoulder 11 (FIG. 3). Within the annular shoulder 11, there is installed a threaded shank 12 which is threaded with the hole 6. At an annular groove 14 (FIG. 3), there is inserted a thrust bearing 13 to prevent the horizontal movement (shown by arrow 31) of the shank 12. The cylindrical boss 7 of the bearing frame 5 is positioned adjacent the annular shoulder 11 of each of the housing frames 9, and the threaded shank 12 is threaded with the threaded hole 6. The threaded shank 12 has a center portion 32 which engages the inner periphery of the annular shoulder 11, which is provided with the thrust bearing 13, and on both ends of the center portion 32 there are respectively oppositely threaded portions of the shank 12 (FIG. 3). In both ends of the threaded shank 12 there are threaded bores 34 which threadably accommodate a bolt 36 which has a hexagonal aperture 35 at its outer end. The hexagonal aperture 35 of the bolt 36 is used for turning of the shank 12 by tooling and therefore the aperture can be provided directly in the ends of the shank 12.

The tooling procedure of the roller die wire drawing device is as follows.

Figure 1:
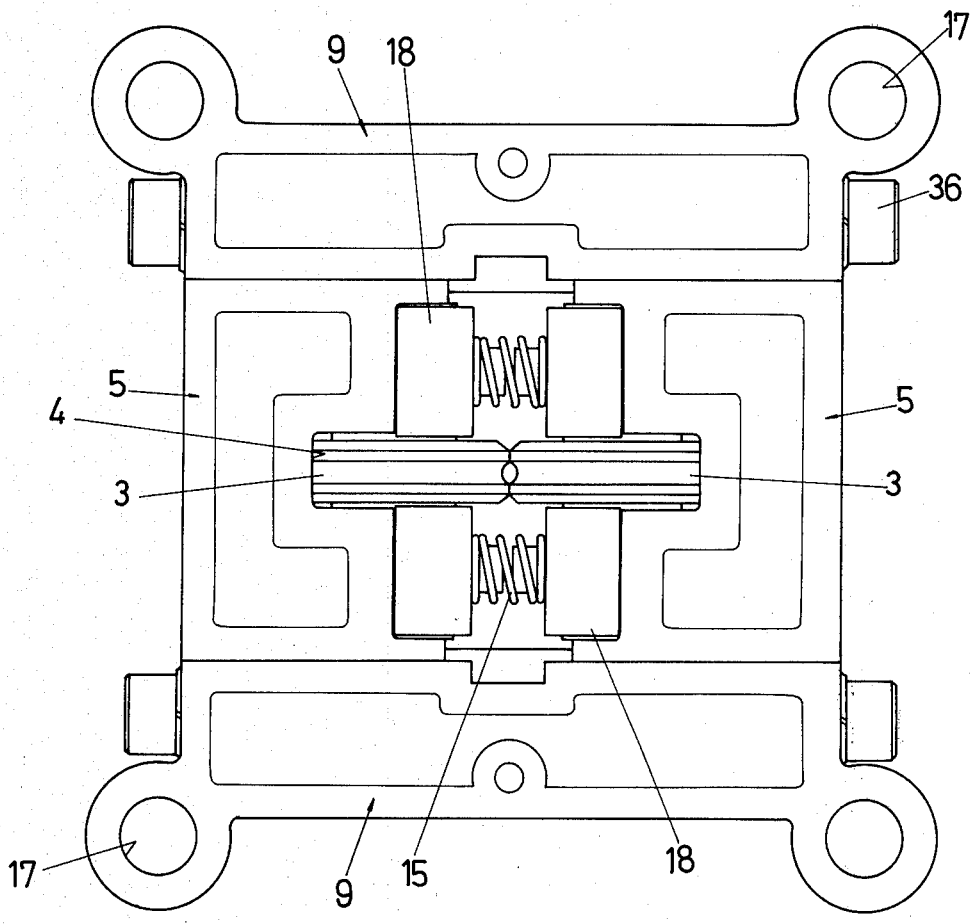
FIG. 1 is a front view of an embodiment of a wire drawing device according to the present invention.
Figure 2:
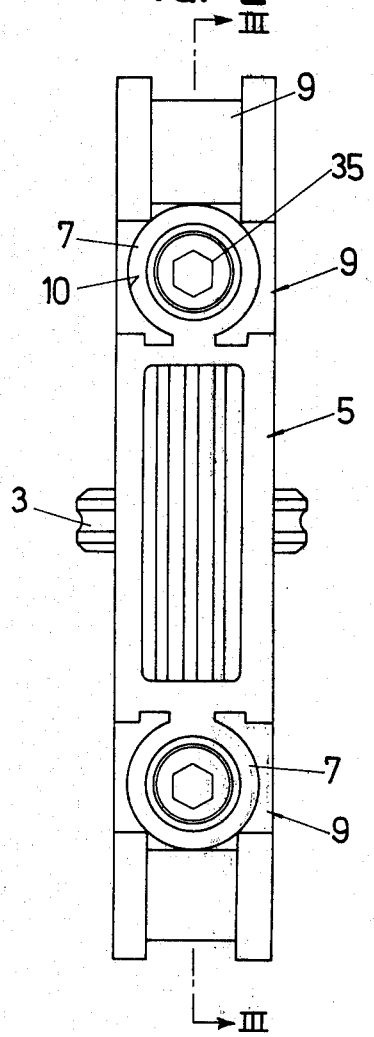
FIG. 2 is a side view of an embodiment of a wire drawing device according to the present invention.
Figure 4:
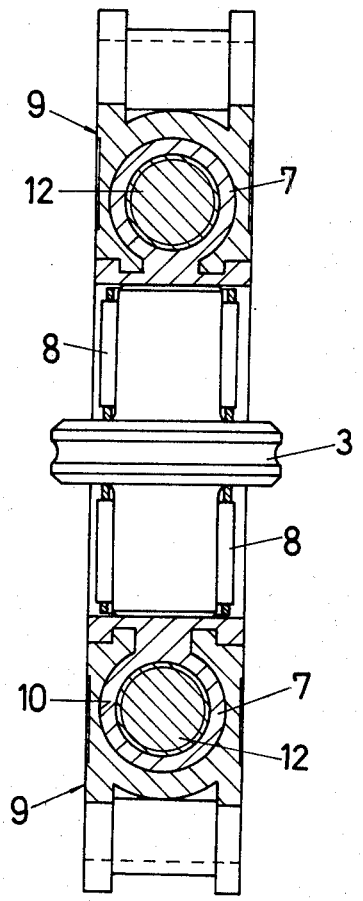
FIG. 4 is a sectional side view taken along the line IV—IV of FIG. 3.
Figure 6:
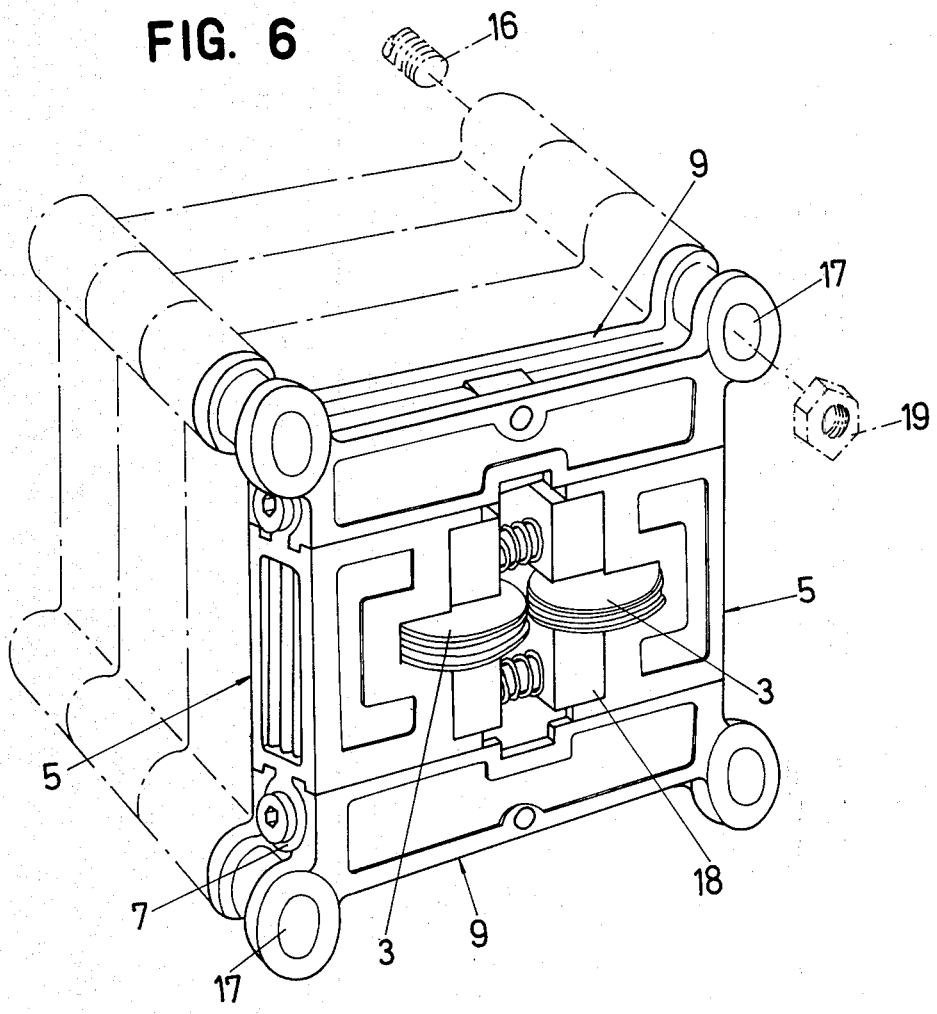
FIG. 6 is a perspective view showing the fastening together of a group of roller die units according to the present invention.

At first the shank 12 is placed inside the annular shoulder 11 of the housing frame 9 and the thrust bearing 13 is inserted therein, so that the shank 12 can rotate but cannot move in the horizontal direction. Then the bearing frames 5 are respectively threaded with the ends of the shank 12, and as the shank 12 is rotated in one direction the bearing frames 5 move toward each other. When the external peripheries of the rollers 3 abut one another, the rotation of the shank is stopped. The needle bearings 8 which are installed within the semicircular bearing spaces are covered by an arch-like metal cover 18, and the metal cover 18 is fixedly positioned so as to fixedly maintain each needle bearing 8 of the grooved rollers 3. The opposing metal covers 18 are held in position by installing springs 15 between the metal covers 18. Each corner of the housing frame 9 has bores 17 therein so as to install assembly shafts 16 therethrough. Thus, a roller die unit can be assembled as shown in FIG. 1. Further, a wire drawing device comprising a plurality of roller die units, as shown in FIG. 6, can be assembled by inserting the assembly shafts 16 through the bores 17 with nuts 19 threaded on the ends of the shafts 16. In this case, if the center axis of each adjacent bore 17 is aligned, it is possible to align or position the roller die unit so that a wire drawing device can comprise a plurality of roller die units in which the center axes of the grooved rollers 3 of each of the opposing bearing frames 5 are parallel, and the center axes of the adjacent rollers 3 contained in adjacent roller die units are perpendicular as shown in FIG. 8.

Figure 8:
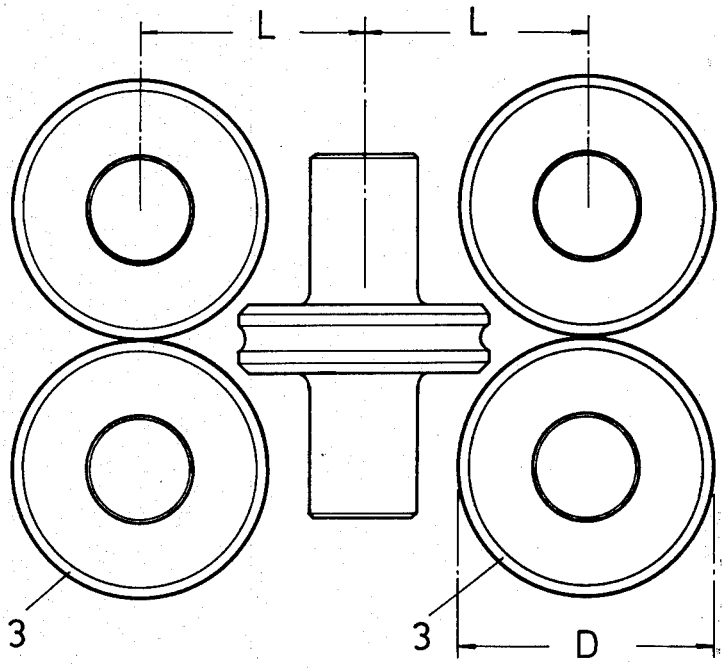
FIG. 8 is a schematic view indicating the space relationship between any two adjacent roller die units.

And furthermore, as shown in FIG. 8, the distance L between adjacent grooved rollers of adjacent frames 5 can be less than the diameter D of the grooved rollers. In this embodiment of a wire drawing device, good results can be attained if the relation between L and D is $L=0.66D\sim0.6D$. Furthermore, the relation between the minimum diameter of round raw wire to be drawn and the diameter D of a grooved roller in this device, which is in the range of 100 mm to 25 mm, is about 2.5 to 1.8 percent. In other words the diameter of the wire is in the range of 2.5 to 1.8 percent of the diameter D. The specific ratio is determined by the type of material comprising the raw wire. The examples of this relation are as follows:

| Diameter of the grooved roller | Diameter of the round wire |
|---|---|
| 100 m/m | 2.5 mm ~ 1.8 mm |
| 60 m/m | 1.5 mm ~ 1.08 mm |
| 45 m/m | 1.12 mm ~ 0.81 mm |
| 35 m/m | 0.85 mm ~ 0.63 mm |
| 25 m/m | 0.65 mm ~ 0.45 mm |

Very efficient wire drawing devices are known whereby one roller of one unit has an elliptical cross-sectional groove and the other roller has a roughly rounded cross-sectional groove. These rollers produced a round wire as a result of a drawing process. In this case, the drawn wire becomes twisted in the space between two sequential roller die units thereby making it impossible to tool drawn wire having a precise cross-sectional shape, and therefore, it is essential to minimize the distance between any two sequential or adjacent rollers. Furthermore, with the aforementioned devices, it is difficult to assemble a group of sequential rollers wherein each set of rollers is positioned in close serial arrangement. Thus, often only two sets of roller units were sequentially arranged resulting in the raw wire being drawn many times through the device. However with the present invention, a wire drawing device can comprise many roller units serially arranged and assembled very closely to one another. Therefore, the raw wire can be drawn therethrough and reduced to the desired cross-sectional area with only one passing through the device.

Figure 7:
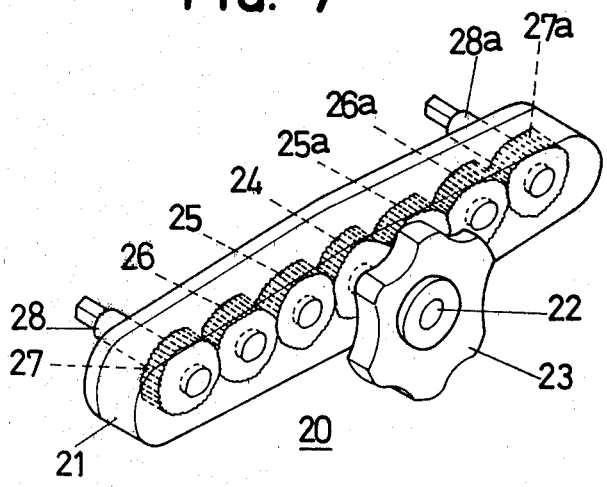
FIG. 7 is a perspective view of a turning device which rotates two threaded shanks simultaneously for adjusting the distance between the two grooved rollers of each roller die unit comprising the wire drawing device of this invention.

The adjustment of the grooved rollers of each unit is accomplished by rotating the shanks 12 which are threadably positioned in the bosses 7 in a manner as previously described. Since the ends of each shank 12 are oppositely threaded, upon rotating the shank 12 each opposing frame 5 is moved an equal distance either toward or away from the opposing frame. Also, so as to allow the rollers each unit to move the same metered amount, a turning device 20 is used as shown in FIG. 7. The turning device 20 is provided with a drive shaft 22 which has a handle 23 fixedly positioned therearound. The drive shaft 22 has a gear 24, which transmits the rotational drive power to output shafts 28, **28*a* through intermediate gears 25, 25*a*, 26, 26*a*, 27, 27*a*. The gearing is arranged such that the output shafts 28, 28*a* rotate with the same angular displacement. The turning device shown in FIG. 7 is not limiting, and other devices could be utilized for rotating the threaded shanks 12. The dimensions of the gears of the turning device 20 are such that the axes of the output shafts 28, 28' respectively correspond to the axes of the threaded shanks 12, and driving of the shaft 22 can be performed either manually or also by electric power. Also, the driving means from the drive shaft to the output shafts can comprise a chain device. The only requirement is that the output shafts 28, 28*a*** rotate with the same angular displacement.

It is easily understood by aforementioned descriptions that this invention includes the following advantages:

Two grooved rollers are respectively installed within one pair of opposing bearing frames, and the bearing frames are assembled such that they are detachably and slidably connected to a housing frame and are adjusted by rotating the shanks. Accordingly, the reaction forces on the rollers caused by the wire drawing process in turn act on the shanks so that there are advantages of the present invention in that the reaction forces have no harmful effect on the housing frames, and the adjustment of distance between two opposing grooved rollers is done simultaneously and precisely. Also, it is possible to serially align the roller die units so that the radial planes of adjacent rollers are perpendicular to one another, thus allowing the distance between grooved rollers of any two adjacent roller die units to be smaller than the diameter of the grooved rollers.

And also four corner bores which are provided in the square housing frame of each unit are positioned such that it is possible to fasten the units together by using four assembly shafts whereby the radial planes of adjacent rollers are perpendicular to one another. Furthermore, as previously described, each unit is assembled with the threaded shanks which resolve the reaction force caused by the wire drawing process, and therefore the housing frames need not be as strongly constructed as heretofore was required.

When using a turning device, the rotation of the drive shaft thereof can be simultaneously imparted to the output shafts so that the clearance between the opposing grooved rollers of each unit can be adjusted easily and precisely.

Finally, the present invention allows a plurality of rollers to be serially aligned and fixed together using common assembly shafts resulting in a single wire drawing device. The reaction forces caused by the wire drawing process are effectively resolved by the tension forces of the shanks. Thus, the relative simple construction of this wire drawing defice of the present invention can withstand the large forces associated with a wire drawing process.

What I claim is:

1. A wire drawing device comprising:

at least two roller die units, each of said roller die units having:

two rollers, each of said rollers having a radially inwardly extending groove around the circumferential edge thereof;

two bearing frames, each of said frames having two threaded holes respectively through opposite ends thereof, said holes in one of said bearing frames being treaded in a direction which is opposite the direction of the threads of said holes in the other of said bearing frames;

each of said rollers being respectively rotatably accommodated in one of said bearing frames;

at least two externally threaded shanks for being threadably received in said holes;

said bearing frames being dimensioned and positioned such that the axes of rotation of said rollers are parallel to one another, said inwardly extending groove of each of said rollers are oppositely aligned with one another thereby defining an aperture for allowing a wire stock to be drawn therethrough, said holes in one of said bearing frames are respectively aligned with said holes in the other of said bearing frames, and said shanks are respectively threadably extended therethrough whereby said bearing frames are attached to and are oppositely aligned with one another; and said shanks being rotatable in one direction to move said rollers toward one another and rotatable in the other direction to move said rollers away from one another;

at least two housing frame means, wherein each of said housing frame means contains said two bearing frames;

attaching means for attaching said housing frame means side-to-side; and wherein said housing frame means are dimensioned and positioned so that, when they are attached, the axes of rotation of said rollers contained in adjacent said housing frame means are other than parallel.

2. A wire drawing device as claimed in claim 1, wherein said attaching means includes:

said housing frame means having bores therethrough, said bores being respectively aligned with one another;

assembly shafts which are respectively extended through aligned bores of said housing frame means; and a fastening means for attaching to the ends of said assembly shafts and fixing said housing frame means with respect to one another.

3. A wire drawing device as claimed in claim 1, wherein:

each of said bearing frames has two cylindrical bosses respectively at opposite ends thereof and which extend in a direction that is substantially perpendicular to the axis of rotation of said roller accommodated therein;

each of said bearing frames has said threaded holes extending in the direction of the length of said cylindrical bosses thereof;

each of said housing frame means has two inwardly facing elongated grooves respectively at opposite ends thereof which are positioned and dimensioned for slidably accommodating said cylindrical bosses of each of said bearing frames of one of said roller die units.

4. A wire drawing device as claimed in claim 2, wherein each of said housing frame means has a substantially square cross-sectional configuration in a plane parallel to the direction of the axes of rotation of said rollers contained therein.

5. A wire drawing device as claimed in claim 1, wherein:

each of said housing frame means and each of said bearing frames accommodated therein have a width in a plane perpendicular to the direction of the axes of rotation of said rollers contained therein which is less than the diameter of said rollers contained therein; and the distance between the axes of rotation of said rollers contained in adjacent said housing frame means being less than the diameter of said rollers thereof.

6. A wire drawing device as claimed in claim 1, further comprising adjustment means operatively associated with said shanks for regulating the distance between said rollers contained in each of said roller die units and thereby regulating the area of the aperture for allowing a wire stock to be drawn therethrough.

7. A wire drawing device as claimed in claim 6, wherein said adjustment means includes:

at least two rotatable output shafts, each of said output shafts being respectively connected to one of said shanks;

a movable drive shaft; and gear means operatively associated with said output shafts and said drive shaft for rotatably moving said output shafts in response to a movement of said drive shaft.

8. A wire drawing device as claimed in claim 7, wherein said gear means has a structure and dimension for rotating said output shafts through substantially equal angular displacements in response to a movement of said drive shaft.

9. A wire drawing device as claimed in claim 3 wherein:

said cylindrical bosses are dimensioned so that there is a gap between them within each of said elongated grooves; and each of said shanks has a thrust bearing means which is operatively associated with the adjacent elongated groove in the spaced defining said gap for preventing substantial axial displacement of each of said shanks.

10. A wire drawing device as claimed in claim 1, wherein each of said roller die units contains a spring biasing means for biasing said rollers away from one another.

* * * * *